US012173500B2

(12) United States Patent
Fencil

(10) Patent No.: US 12,173,500 B2
(45) Date of Patent: Dec. 24, 2024

(54) PARTITION SYSTEM

(71) Applicant: Michael Fencil, Naples, FL (US)

(72) Inventor: Michael Fencil, Naples, FL (US)

( * ) Notice: Subject to any disclaimer, the term of this patent is extended or adjusted under 35 U.S.C. 154(b) by 371 days.

(21) Appl. No.: 17/518,094

(22) Filed: Nov. 3, 2021

(65) Prior Publication Data

US 2023/0133782 A1 May 4, 2023

(51) Int. Cl.
*E04B 2/74* (2006.01)
*E04B 2/76* (2006.01)

(52) U.S. Cl.
CPC .... *E04B 2/7427* (2013.01); *E04B 2002/7461* (2013.01); *E04B 2002/7488* (2013.01); *E04B 2/767* (2013.01)

(58) Field of Classification Search
CPC .... E04B 2/7422; E04B 2/7425; E04B 2/7427; E04B 2/7429; E04B 2/7431; E04B 2/7433; E04B 2/767; E04B 2002/7461; E04B 2002/7487; E04B 2002/7488; A47B 83/001; A47B 2083/005; E06B 9/02; E06B 9/04; E06B 9/06; E06B 9/0607; E06B 9/0615; E06B 2009/002
USPC ..... 52/36.1, 65; 40/539
See application file for complete search history.

(56) References Cited

U.S. PATENT DOCUMENTS 3,592,289 A 7/1971 Aysta et al.
4,338,990 A * 7/1982 Blodee ..... E06B 3/5045 312/265.5
4,625,633 A * 12/1986 Martin ..... F24F 7/06 55/385.2
4,926,609 A 5/1990 Arico
5,092,385 A 3/1992 Beaulieu
5,287,909 A * 2/1994 King ..... A47G 5/00 160/229.1
5,873,205 A * 2/1999 Hanlon ..... E04B 2/7416 49/404
6,009,930 A * 1/2000 Jantschek ..... E04B 2/7431 160/352
6,293,328 B1 9/2001 Fremont
6,481,163 B1 * 11/2002 King ..... E04B 2/7427 52/36.6
6,484,344 B1 * 11/2002 Cooper ..... A61G 3/061 14/71.1
7,735,537 B2 * 6/2010 Hardt, II ..... E04B 2/7427 160/135
8,640,391 B2 * 2/2014 Newkirk ..... E04F 19/08 52/220.1
10,040,385 B2 * 8/2018 Stevens ..... B60P 1/43
11,419,414 B2 * 8/2022 Madimenos ..... A47B 83/001
11,512,522 B2 * 11/2022 Martin ..... E05D 15/0678
(Continued)

OTHER PUBLICATIONS

3 Panel Art Show Display; https://www.displays2go.com/P-32114/3-Panel-Art-Show-Display-U-Shaped-Design?utm_content=Shopping&gclid=Cj0KCQjwit_8BRCoAlscoARisAlx3Rj5n; 3 pages.
(Continued)

*Primary Examiner* — Ryan D Kwiecinski
(74) *Attorney, Agent, or Firm* — Brooks Kushman P.C.

(57) ABSTRACT

A partition system includes a primary wall and a secondary wall. The primary wall has a first frame. The secondary wall has a second frame secured to the first frame such that the secondary wall is rotatable about a first axis between a substantially planar position and a nonplanar position relative to the primary wall.

21 Claims, 6 Drawing Sheets

(56) References Cited

U.S. PATENT DOCUMENTS

| | | | | |
|---|---|---|---|---|
| 2003/0221798 | A1* | 12/2003 | Hunt | A47G 5/00 160/135 |
| 2008/0086964 | A1* | 4/2008 | Hardt | E04B 2/7427 52/239 |
| 2008/0104908 | A1* | 5/2008 | Jensen | A47G 5/00 52/241 |
| 2010/0051211 | A1* | 3/2010 | Chen | E04B 2/7427 160/135 |
| 2010/0170642 | A1 | 7/2010 | Chen | |
| 2011/0037360 | A1* | 2/2011 | Jakins | A47B 63/04 312/249.8 |
| 2014/0345174 | A1* | 11/2014 | Weight | G09F 15/0012 40/541 |
| 2017/0306693 | A1* | 10/2017 | Potter | E06B 9/04 |
| 2018/0251975 | A1* | 9/2018 | Harber | E04C 2/38 |

OTHER PUBLICATIONS

Fold N Go Tabletop Display—6'—Blank; 4Imprint; 2 pages.
Hook and Loop Display Board with Halogen Lights; https://www.displays2go.com/P-23883-Hook-Loop-Display-Board-Halogen-Lights-Illuminates-Announcements?utm_content=Shopping&gclid=Cj0KCQj; 3 pages.

* cited by examiner

PARTITION SYSTEM

TECHNICAL FIELD

The present disclosure relates to screens or partition walls that are configured to subdivide a defined space.

BACKGROUND

Partition walls may be utilized to subdivide a defined space.

SUMMARY

A partition system includes a primary wall and a secondary wall. The primary wall has a first frame. The secondary wall has a second frame that is secured to the first frame via a hinge such that the secondary wall is rotatable about an axis relative to the primary wall. The hinge is arranged such that adjacent side edges of the first and second frames define a gap therebetween when the secondary wall is in a nonplanar position relative to the primary wall. The hinge is further arranged such that the adjacent side edges of the first and second frames contact each other and close the gap when the secondary wall is in a substantially planar position relative to the primary wall.

A partition system includes a primary wall, a secondary wall, and an extension panel. The primary wall has a first frame. The secondary wall has a second frame that is secured to the first frame such that the secondary wall is rotatable about an axis relative to the primary wall. The second frame defines an internal cavity and a slot along an outer side edge. The extension panel is slidably secured to the second frame within the internal cavity. The extension panel is configured to slide at least partially into and out of the internal cavity via the slot.

A partition system includes a primary wall, a secondary wall, and a subdivider panel. The primary wall has a first frame. The secondary wall has a second frame secured to the first frame such that the secondary wall is rotatable about a first axis between a substantially planar position and a nonplanar position relative to the primary wall. The subdivider panel is rotatably secured to the second frame such that the subdivider panel is configured to pivot about a second axis relative to the second frame. The subdivider panel is configured to transition between a first position that is substantially parallel with the secondary wall and a second position that radially offset from secondary wall along the second axis.

A partition system includes support base, a primary wall, and a secondary wall. The primary wall has a first frame rotatably secured to the support base such that the primary wall is configured to pivot about a first substantially vertical axis relative to the support base. The secondary wall has a second frame secured to the first frame via a hinge such that the secondary wall is rotatable about a second substantially vertical axis relative to the primary wall.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Many of the workers in today's workforce are transitioning to a work-from-home setting. This has many advantages for both employees and employers. For example, employee commute time is eliminated, costs associated with commuting (e.g., fuel cost, public transportation cost, etc.) is eliminated, the required amount commercial space to operate is reduced, etc. Working from home, however, may have some drawbacks. For example, with the advent of facetime meetings the décor within the background of one's home may not represent a desired professional environment. On the other hand, it is also not desirable to transition the décor of one's home into a traditional workspace. The partition system described herein solves this problem. More specifically, the partition system may be arranged such that a first side has a more office friendly décor and a second side has a more home friendly décor. The first side of the partition system, having the more office friendly décor, may be placed within the field of view of the camera capturing video during facetime meetings such that the first side of the partition system encompasses the entire background of the camera's field of view. The second side of the partition system, having the more home friendly décor, may be positioned toward the main living space within the home.

Figure 1:
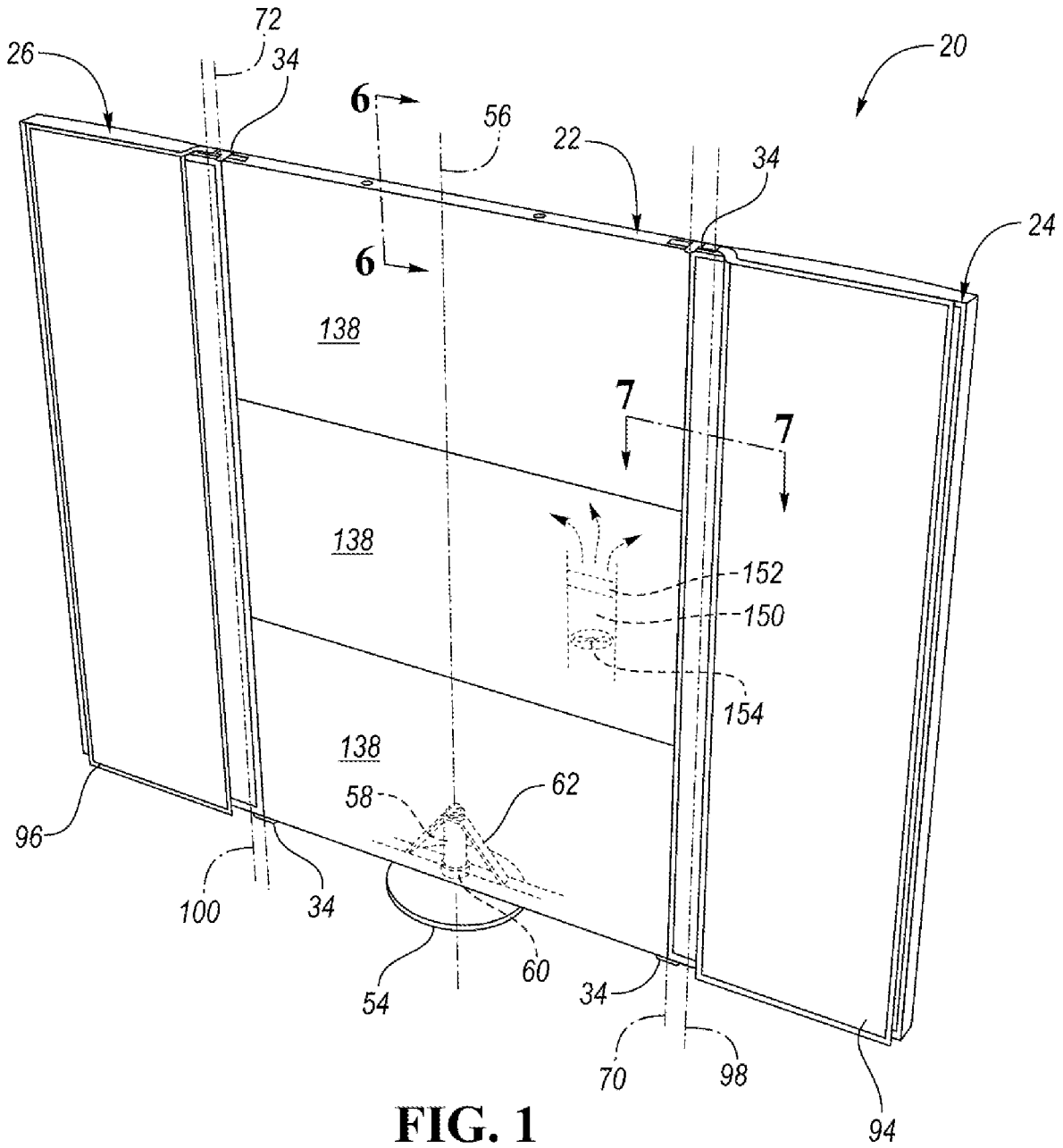
FIG. 1 is an isometric front view of a partition system.
Figure 2:
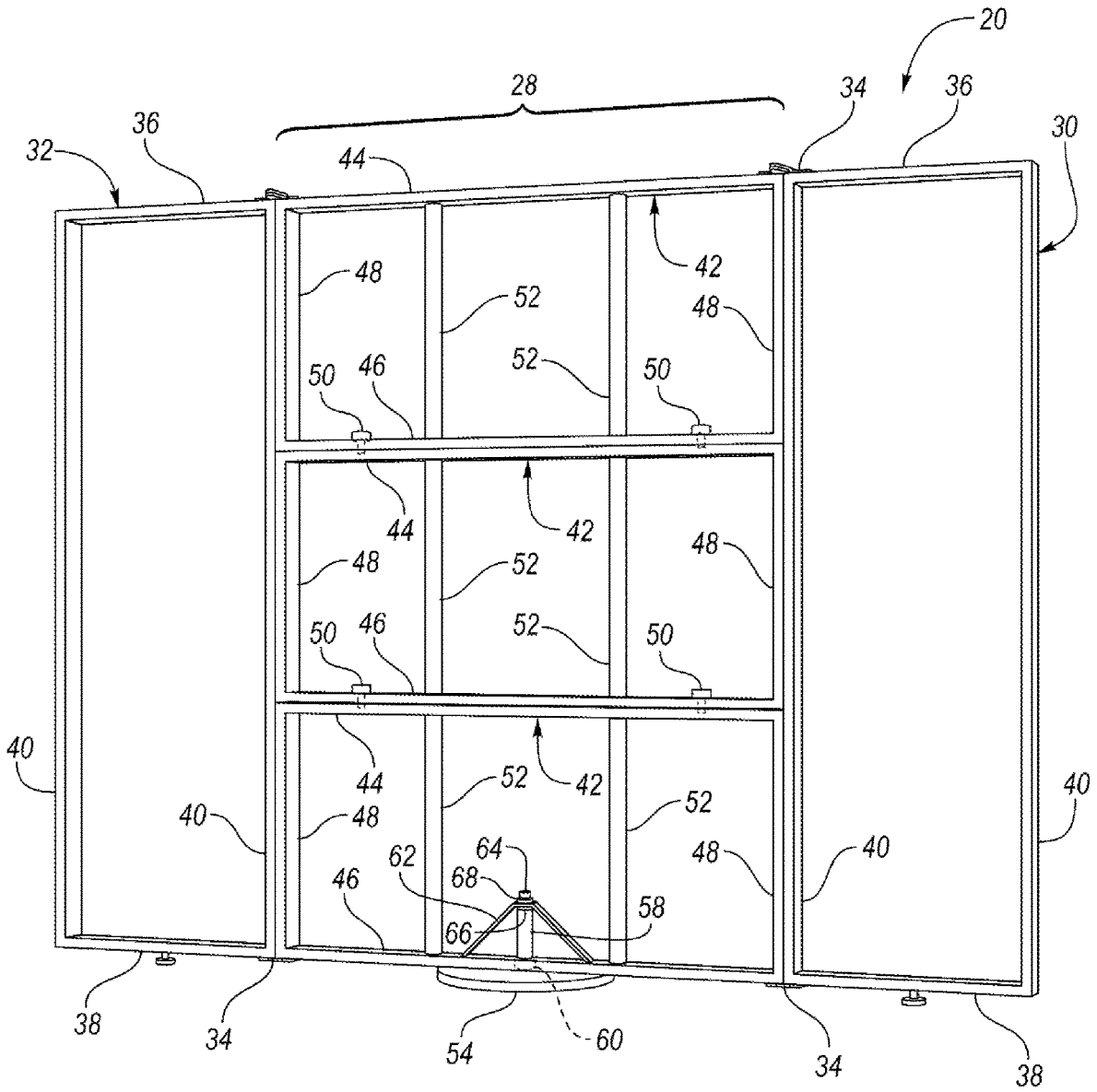
FIG. 2 is an isometric view of a frame for a primary wall of the partition system.

Referring to FIGS. 1 and 2 the partition system 20 is illustrated. The partition system 20 includes a first or primary wall 22, a second or secondary wall 24, and a third or tertiary wall 26. The primary wall 22 may be referred to the center wall while the secondary wall 24 and the tertiary wall 26 may be referred to as opposing side walls that are disposed on opposite sides of the primary wall 22. The primary wall 22 has a first frame 28. The first frame 28 encompasses the outer perimeter or periphery of the primary wall 22. The secondary wall 24 has a second frame 30. The second frame 30 encompasses the outer perimeter or periphery of the secondary wall 24. The tertiary wall 26 has a third frame 32. The third frame 32 encompasses the outer perimeter or periphery of the tertiary wall 26. The secondary wall 24 and the tertiary wall 26 are secured to opposing sides of the primary wall 22. More specifically, the second frame 30 and the third frame 32 may be secured to opposing sides of the first frame 28 via hinges 34, such that the secondary wall 24 and the tertiary wall 26 are secured to and rotatable relative to the primary wall 22.

The second frame 30 and the third frame 32 each include a top member 36, a bottom member 38, and two side members 40 forming a box or rectangular shape. The first frame 28 may have a similar structure as the second frame 30 and the third frame 32 (i.e., the first frame 28 may have a top member, a bottom member, and two side members forming a box or rectangular shape). Alternatively, and as showing in FIG. 2, the first frame 28 may include a series of stacked sub-frames 42, each sub-frame 42 including a top member 44, a bottom member 46, and two side members 48 forming a box or rectangular shape. Top members 44 and bottom members 46 of adjacent sub-frames 42 may be secured to each other via fasteners 50. The fasteners 50 may be any type of fastener. However, a combination of threaded fastener extending through orifices defined in the top and bottom members 44, 46 and a thumb nut may be preferable for ease of assembly and disassembly.

The first frame 28 may also have a wider base or footprint relative to the second frame 30 and the third frame 32. Therefore, additional support members 52 may be secured to the sub-frames 42 within the spaces defined between the top members 44, bottom members 46, and side members 48 of the sub-frames 42. The additional support members 52 may be secured to top members 44 and bottom members 46 via fasteners.

The partition system 20 may further include a support base 54. The primary wall 22 may be secured to the support base 54. More specifically, the first frame 28 of the primary wall 22 may be rotatably secured to the support base 54 such that the primary wall 22 is configured to pivot about a first axis 56 relative to the support base 54. The first axis 56 may be a substantially vertical axis. Substantially vertical may refer to any incremental angle that is between exactly vertical and 15° from exactly vertical. A post 58 may extend upward from the base 54 and through an orifice defined in the lower bottom member 44 of the first frame 28. A bushing 60 may be disposed within the orifice defined in the lower bottom member 44 of the first frame 28. The bushing 60 may be rigidly affixed to the lower bottom member 44 of the first frame 28. The post 58 may be rigidly affixed to the base 54 and may extend through the bushing 60. The post 58 may be secured to the base 54 via a fastener and a keyed engagement between a protrusion on the bottom of the post 58 and a keyed orifice defined in the base 54 in order to prevent relative rotational movement between the post 58 and the base 54. The entire primary wall 22 may be configured to pivot about the first axis 56 relative to the support base 54 via relative rotational movement between the bushing 60 and the post 58.

An A-frame support 62 may be rigidly secured to the top of the lower bottom member 44 of the first frame 28 and rotatably secured to the post 58 to provide additional support to the first frame 22. More specifically, the A-frame support 62 may be rotatably secured to the post 58 via a pin or fastener 64 that engages the post 58. The fastener 64 may include threads that engage either the post 58 or the A-frame support 62 and an unthreaded portion that engages the other of the post 58 or the A-frame support 62 so that the fastener 64 is rigidly affixed to the one of the post 58 and the A-frame support 62 and rotatably engages the other of the post 58 and the A-frame support 62. A first washer 66 may be disposed between the A-frame support 62 and the post 58 in order to reduce or absorb the friction between the A-frame support 62 and the post 58 during rotation of the primary wall 22 relative to base 54. A second washer 68 may be disposed between the A-frame support 62 and the fastener 64 in order to reduce or absorb the friction between the A-frame support 62 and the fastener 64 during rotation of the primary wall 22 relative to base 54, particularly if the fastener 64 is rigidly secured to the post 58 and rotatably secured to the A-frame support 62. If the fastener 64 is rotatably secured to the post 58 and rigidly secured to the A-frame support 62, the second washer 68 may not be required.

Figure 3:
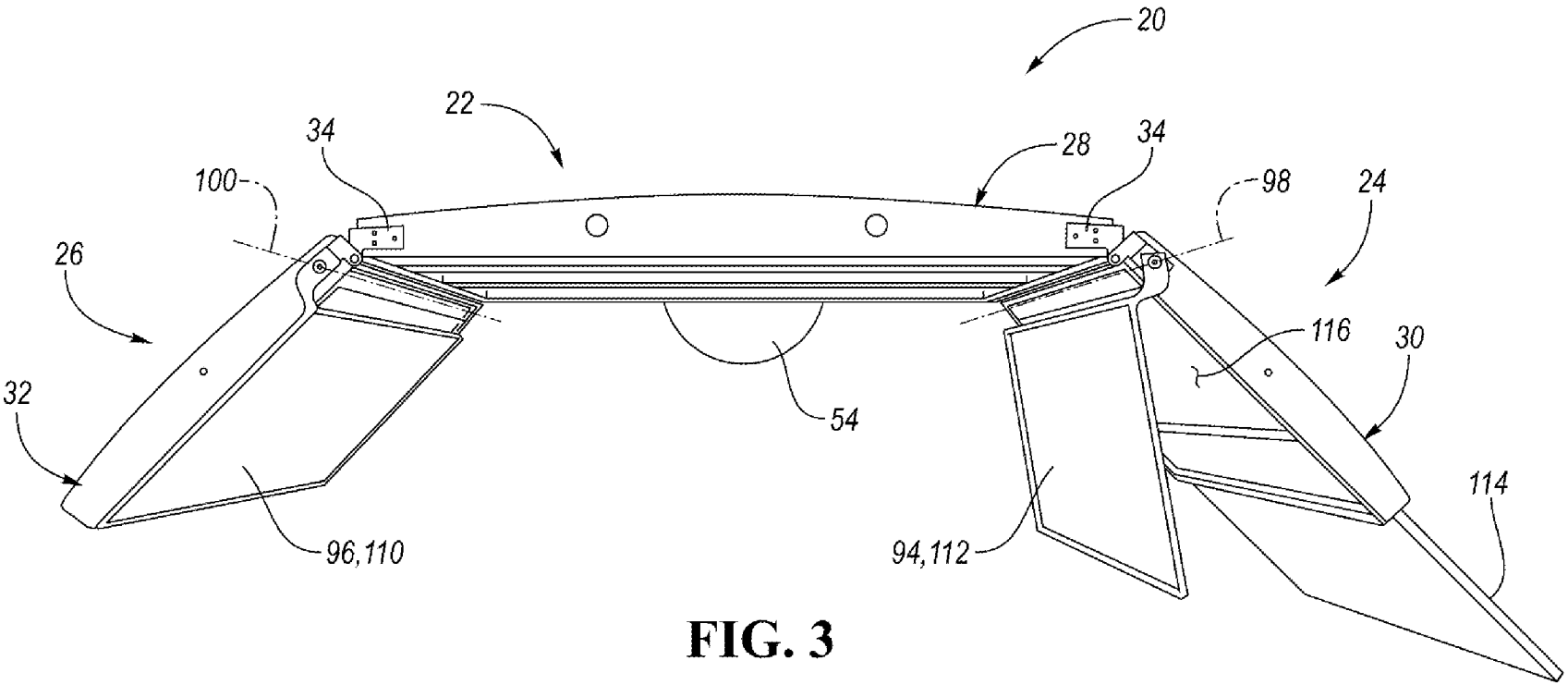
FIG. 3 is a top view of the partition system.
Figure 4:
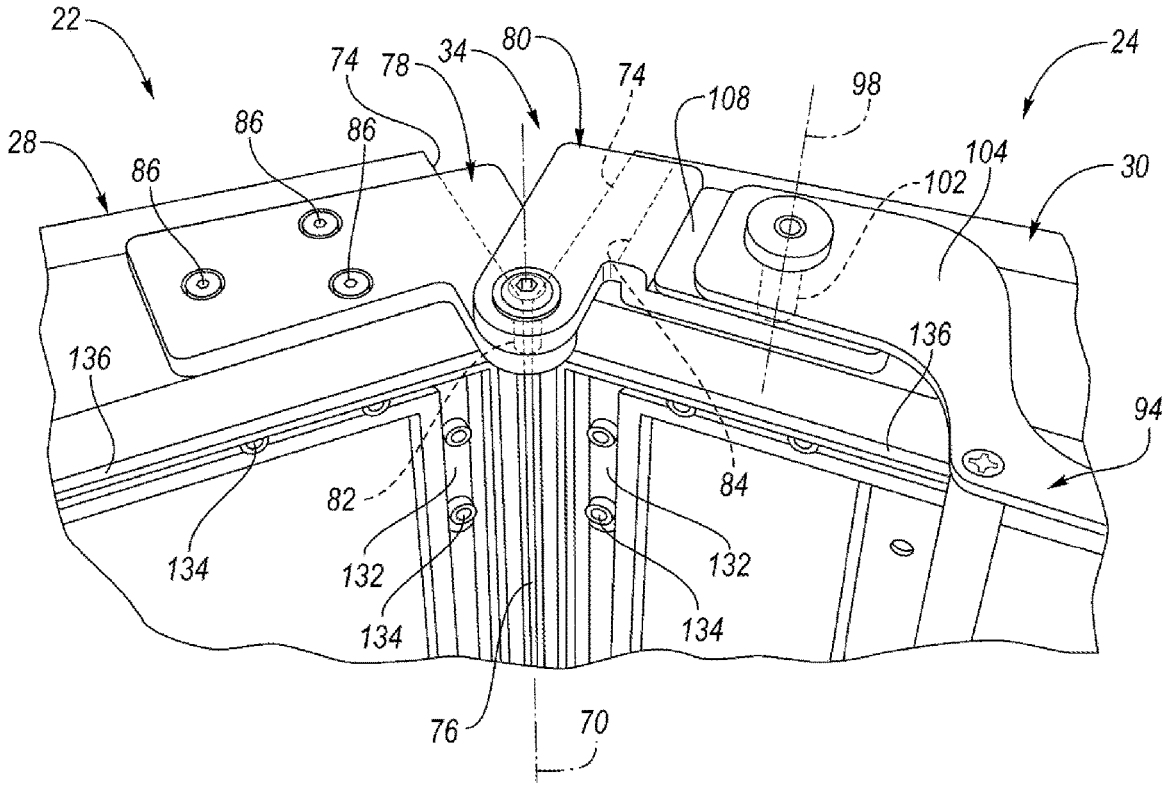
FIG. 4 is an isometric view of a hinge that rotatably connects primary and secondary walls of the partition system to each other with the primary and secondary walls in nonplanar positions relative to each other.
Figure 5:
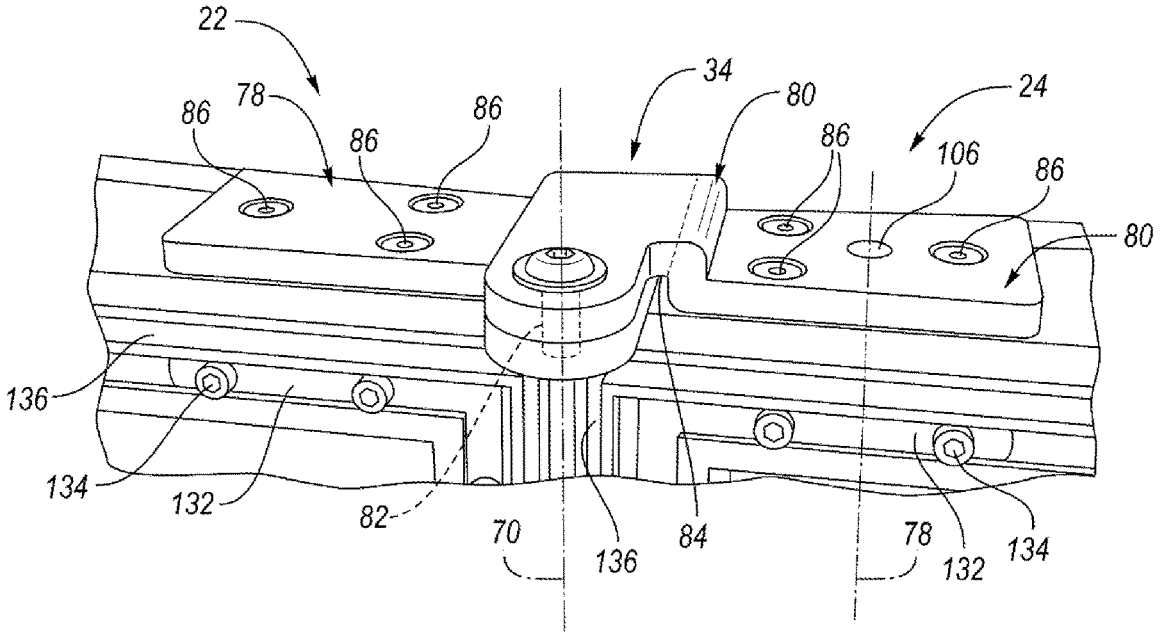
FIG. 5 is an isometric view of the hinge with the primary and secondary walls in substantially planar positions relative to each other.

Referring now to FIGS. 1-5 and 8, the hinges 34 are described in further detail. It is noted that FIGS. 4 and 5 only depict the primary wall 22 secondary wall 24. However, it should be understood that the tertiary wall 26 may be a mirror image of the secondary wall 24 and that any description in FIGS. 4 and 5 with respect to the primary wall 22 and the secondary wall 24 will be equally applicable to a description of the primary wall 22 and the tertiary wall 26 albeit with the understanding the that tertiary wall 26 is a mirror image of the secondary wall 24. It is further noted that the hinges 34 depicted in FIGS. 4 and 5 depict the hinges 34 on the top side of the partition system 22. However, it should be understood that the hinges 34 depicted in FIGS. 4 and 5 may also represent the hinges 34 on the bottom side of the partition system 22 as well. Simply rotating the images in FIGS. 4 and 5 by 180° may be construed as a representation of the hinges 34 on the bottom side of the partition system 20.

The second frame 30 and the third frame 32 are each secured to first frame 28 via a pair of hinges 34 (i.e., one hinge along the top and one hinge along the bottom for each connection) such that secondary wall 24 and the tertiary wall 26 are each rotatable about relative to the primary wall 22. More specifically, the secondary wall 24 may be rotatable about the hinges 34 relative to the primary wall 22 via a second axis 70 and the tertiary wall 26 may be rotatable about the hinges 34 relative to the primary wall 22 via a third axis 72. The second axis 70 and the third axis 72 may each be substantially vertical axes. Substantially vertical may refer to any incremental angle that is between exactly vertical and 15° from exactly vertical.

The hinges 34 are arranged such that adjacent side edges 74 of the first frame 28 and the second frame 30 are sufficiently spaced apart to define a gap 76 therebetween when the secondary wall 24 is in a nonplanar position relative to the primary wall 22. The secondary wall 24 being in a nonplanar position relative to the primary wall 22 is depicted in FIGS. 3 and 4. The hinges 34 are also arranged such that adjacent side edges 74 of the first frame 28 and the second frame 30 contact each other and close the gap 76 when the secondary wall 24 is in a substantially planar position relative to the primary wall 22. Substantially planar may refer to any incremental relative angle between two of the walls (e.g., the primary wall 22 and secondary wall 24 or the primary wall 22 and tertiary wall 26) that is between exactly planar (i.e., where the walls are exactly on the same plane) and 10° from exactly planar. The secondary wall 24 being in a substantially planar position relative to the primary wall 22 is depicted in FIGS. 1 and 5.

The hinges 34 each include a first plate 78 that is secured to the first frame 28, a second plate 80 that is secured to the second frame 30, and a pivot 82 that defines the second axis 70 and rotatably secures the first plate 78 to the second plate 80. The pivot 82 may be horizontally offset from the first frame 28 and the second frame 30. Stated in other terms the pivot 82, and the portions both the first plate 78 and the second plate 80 that receive the pivot 82, overhang the first frame 28 and the second frame 30. The pivot 82 may be a pin or a fastener. If the pivot 82 is a fastener, the pivot 82 may extends through a through hole defined by the second plate 80 and may engage a threaded orifice defined by the first plate 78, or vice versa. The second plate 80 may define a notch 84 configured to receive the first plate 78 when the secondary wall 24 is in the substantially planar position relative to the primary wall 22, or vice versa.

The hinges 34 may be secured to the frames (i.e., first frame 28, second frame 30, or third frame 32) via fasteners 86. More specifically, each first plate 78 and each second plate 80 may be secured to blocks 88 (See FIG. 8) that are disposed within spaces or cavities defined within the top members 44 and the bottom members 46 of the first frame 28 and within the top members 36 and bottom members 38 of the second and third frames 30, 32. The blocks 88 provide additional stability and rigidity to the frames (i.e., first frame 28, second frame 30, and third frame 32) along the hinges 34. The blocks 88 may be secured to the respective members (e.g., top member 44, bottom member 46, top member 36 or bottom member 38) via fasteners 90 that extend through a series of through holes, which may be countersunk holes, defined in the respective members and engage tapped holes defined within the blocks 88. Each first plate 78 and second plate 80 are in turn secured to one of the blocks 88 via the fasteners 86, which extend through a series of through holes 92 defined in the respective members and engage tapped holes defined within the blocks 88.

Referring now to FIGS. 1 and 3-5, subdivider panels are illustrated in further detail. A first subdivider panel 94 is rotatably secured to the second frame 30 and a second subdivider panel 96 is rotatably secured to the third frame 32. The first subdivider panel 94 is configured to rotate about a fourth axis 98 relative to the second frame 30 and the second subdivider panel 96 is configured to rotate about a fifth axis 100 relative to the third frame 32. The subdivider panels 94, 96 may be rotatably secured to the hinges 34 via a pivot 102. Each subdivider panel 94, 96 may be secured to two hinges 34 via two pivots 102, one along the top of the partition system 20 and one along the bottom of the partition system 20. Simply rotating the image in FIG. 4 by 180° may be construed as representative of an engagement between the subdivider panels 94, 96 and hinges 34 via the pivots 102 on the bottom side of the partition system 20.

Each pivot 102 may be a pin or a fastener. More specifically, each pivot 102 may be a fastener and thumb nut combination or a thumb screw for ease of assembly and disassembly. If the pivots 102 are thumb screws, each pivot 102 may extend through a through hole defined by an offset arm 104 that extends from each subdivider panels 94, 96 and may engage a tapped hole 106 defined by either the first plate 78 or the second plate 80 of the hinge. If the pivots 102 are fastener and thumb nut combinations, hole 106 may also be a through hole. A friction reducing pad or plate 108 may be disposed between each offset arm 104 and the first plate 78 or the second plate 80 in order to reduce or absorb the friction between the offset arms 104 and the first plates 78 or the second plates 80 while the subdivider panels 94, 96 are being rotated.

The first subdivider panel 94 and the second subdivider panel 96 are each configured to transition between first positions 110 that are substantially parallel with the secondary wall 24 and tertiary wall 26, respectively, and second positions 112 that are radially offset from secondary wall 24 and tertiary wall 26, respectively, relative to the fourth and fifth axes 98, 100, respectively. The second subdivider panel 96 is shown to be in the first position 110 in FIG. 3 while the first subdivider panel 94 is shown to be in the second position 112 in FIG. 3. It is noted that the second positions 112 may include any position that is not substantially parallel with a respective wall up to an outermost position at a maximum radial offset from a respective wall. The maximum radial offset may be set by physical stops or by interference with other components of the partition system 20.

Referring to FIGS. 1, 3, and 9-10, an extension panel system is illustrated in further detail. It is noted that the Figures only depict the extension panel system that is secured to the secondary wall 24. However, it should be understood that since the tertiary wall 26 may be a mirror image of the secondary wall 24, any description in FIGS. 3 and 9-10 with respect the to the extension panel system that is secured to the secondary wall 24 will be equally applicable to a description of the tertiary wall 26 albeit with the understanding the that tertiary wall 26 is a mirror image of the secondary wall 24.

Figure 10:
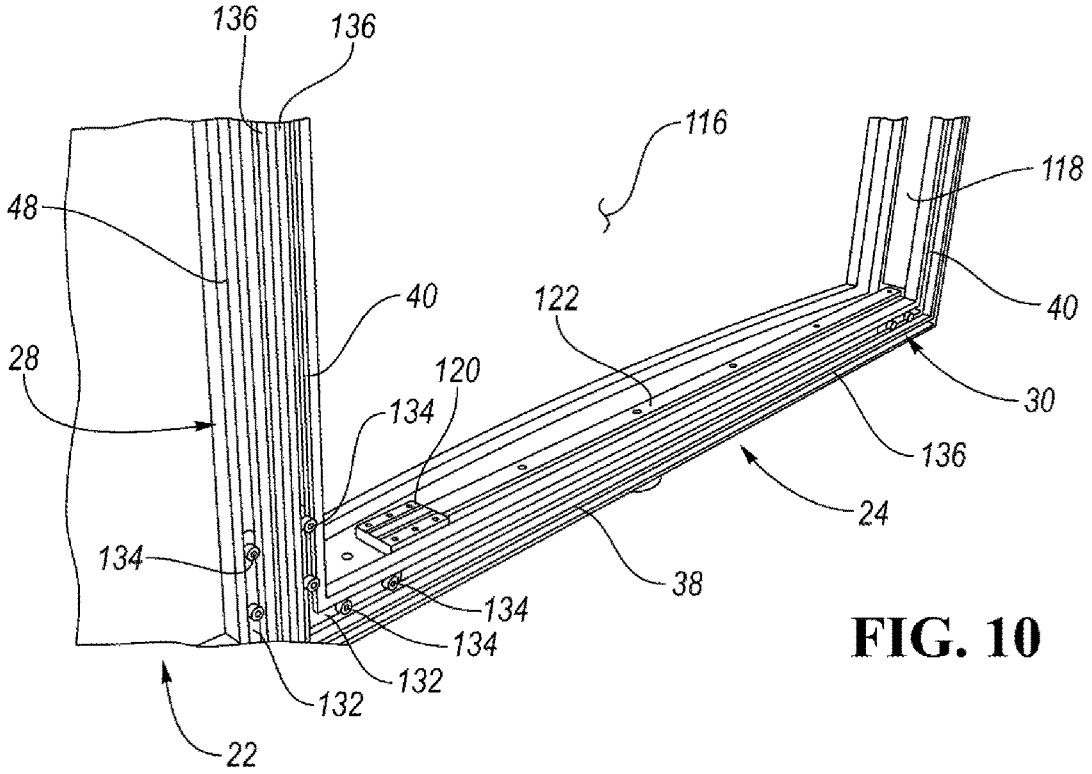
FIG. 10 is a partial view of the partition system illustrating a sliding mechanism for the extension panel.

The extension panel system includes an extension panel 114 that is slidable into and out of the secondary wall 24. The extension panel 114 effectively increases the overall width the secondary wall 24 when extended, as illustrated in FIGS. 3 and 10. The extension panel 114 effectively decreases the overall length of the secondary wall 24 when retracted, as illustrated in FIG. 1. The second frame 30 defines an internal cavity 116 and a slot 118 along an opposing side edge (e.g., side members 40) that is opposite relative to the adjacent side edges 74. The extension panel 114 is slidably secured to the second frame within the internal cavity 116 and is configured to slide at least partially into and out of the internal cavity 116 via the slot 118.

The extension panel 114 may be secured to the second frame 30 by any slidable mechanism known in the art (e.g., a ball screw/ball nut combination, via roller or ball bearings disposed within a linear guide, bearing and rail combination, etc.). More, specifically, the extension panel 114 may be secured (e.g., via fasteners) to one or more bearing blocks 120 that are slidable along rails 122. The rails 122 in turn may be secured (e.g., via fasteners) to the second frame 30 within the internal cavity 116. The extension panel 114 has been removed in FIG. 10 for ease of illustration. It is noted that only one bearing block 120 and rail 122 combination is illustrated along the bottom of the internal cavity 116 (i.e., the rail 122 is secured to the bottom member 38 and the block 120 is secured to the bottom of the extension panel 114). However, it should be understood that a second block 120 and rail 122 combination may be secured to the second frame 30 along the top of the internal cavity 116 (i.e., the second rail 122 may be secured to the top member 36 and the second block 120 may secured to the top of the extension panel 114). Simply rotating the image in FIG. 10 by 180° and renumbering bottom member 38 as top member 36 may be construed as representative of a second block 120 and rail 122 combination disposed along the top of the internal cavity 116.

Figure 6:
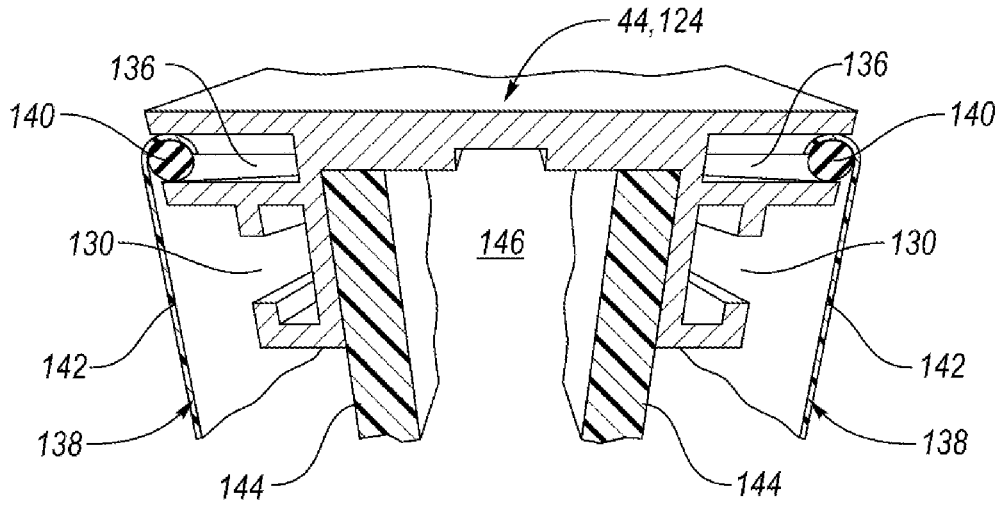
FIG. 6 is a cross-sectional view of a top portion of the primary wall taken along line 5-5 in FIG. 1.
Figure 7:
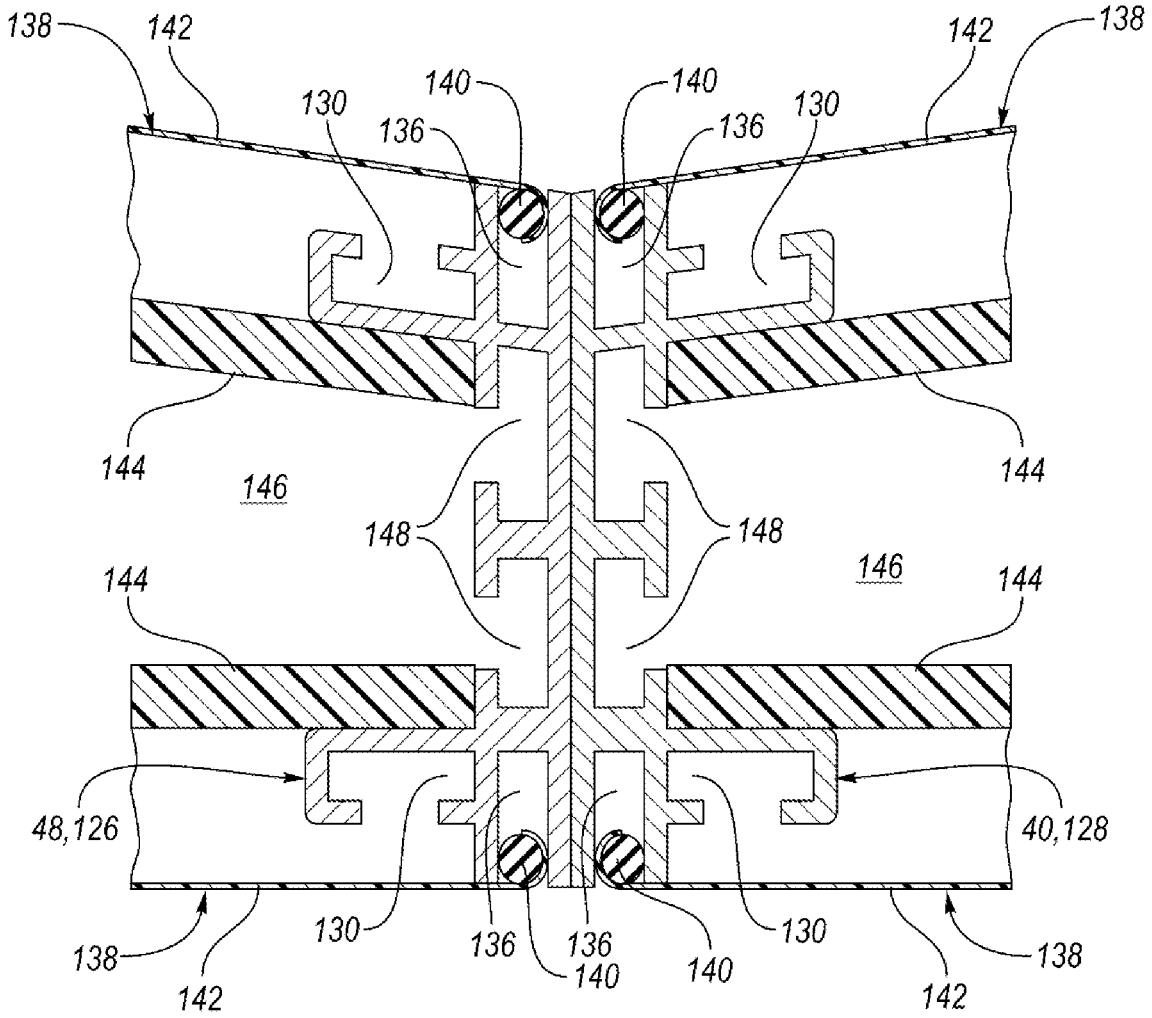
FIG. 7 is a cross-sectional view of adjacent side portions of primary and secondary walls taken along line 6-6 in FIG. 1.
Figure 8:
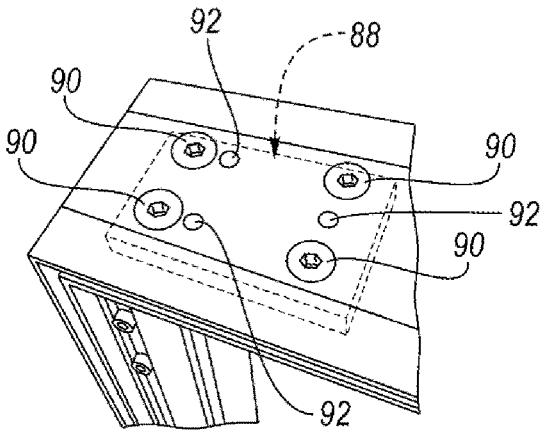
FIG. 8 is a top view of a portion of the primary frame illustrating a support block.
Figure 9:
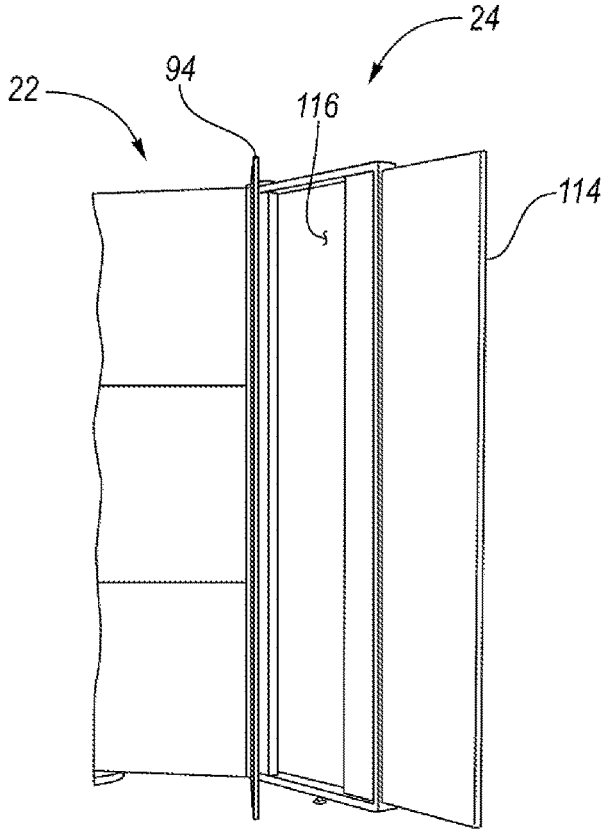
FIG. 9 is a partial view of the partition system illustrating an extension panel.

Referring to FIGS. 6 and 7 in conjunction with FIGS. 1, 4-5, and 10, a graphic display system and various internal components of the partition system 20 are illustrated in further detail. It is noted that FIGS. 6 and 7 only depict the graphic display system and the various internal components of the partition system 20 with respect to the primary wall 22 and the secondary wall 24. However, it should be understood that since the tertiary wall 26 may be a mirror image of the secondary wall 24, any description in FIGS. 6 and 7, and any other Figure, with respect the to the graphic display system and the various internal components of the partition system 20 will be equally applicable to a description of the tertiary wall 26 albeit with the understanding the that tertiary wall 26 is a mirror image of the secondary wall 24.

The members forming the frames of each wall may be constructed to have a particular functional cross-sectional shape. More specifically, the members forming the frames of each wall may have features, such as protrusions or extensions, defining internal spaces, channels, T-slots, etc. The members forming the frames of each wall may be extruded components, such as extruded aluminum or extruded plastic components. The cross-section 124 in FIG. 6 is shown as representing one of the top members 44 of the first frame 28. However, each top member 44 and bottom member 46 of the first frame 28, and each top member 36 and bottom member 38 of the second frame 30 or third frame 32, may have the same cross-sectional shape as illustrated in FIG. 6. The bottom members 46, 38, however, will be mirror images of what is illustrated in FIG. 6. The cross-sections 126, 128 in FIG. 7 are show as representing one of the side members 48 of the first frame 28 and an adjacent side member 40 of the second frame 30, respectively. It should be understood that the two side members 48 of each sub-frame 42 will be mirror images of each other, the two side members 48 of the second frame 30 will be mirror images of each other, and the two side members 48 of the 30 third frame 32 will be mirror images of each other.

Each cross-section 124, 126, 128 defines outwardly facing T-slots 130. The outwardly facing T-slots 130 are configured to receive L-brackets 132. The L-brackets 132 are depicted in FIGS. 4-5 and 10. The L-brackets 132 secure adjacent members to each other. For example, the L-brackets 132 secure the top members 44 to the side members 48, the bottom members 46 to the side members 48, the top members 36 to the side members 40, and the bottom members 46 to the side members 40. Fasteners 134 may engage threaded holes defined by the L-brackets 132 to secure the L-brackets 132 to the corresponding members.

Each cross-section 124, 126, 128 also defines outwardly extending channels 136. The adjacent members (e.g., top members 36, 44, bottom members 38, 46, and side members 40, 48) of each frame (e.g., the first frame 28, second frame 30, and third frame 32) are arranged such that the channels 136 of the members align to form a single channel that extends along or about an outer periphery of each wall (i.e., primary wall 22, secondary wall 24, and tertiary wall 26). In the case of the primary wall 22, notches may be cut into some of the members (e.g., top members, 44, bottom members 46, and/or side members 48) so that the single channel that extends along or about the outer periphery of the primary wall 22 is connected between adjacent sub-frames 42. Alternatively, such notches may be omitted so that the primary wall 22 includes separate channels that extend along or about an outer periphery of each sub-frame 42.

Graphic displays 138 may be disposed with the channels 136. More specifically, the graphic displays 138 may have outer edges 140 that are disposed within the channels 136 and an image portion 142 that within the outer edges. The graphic displays may more specifically be silicone edge graphics (SEGs). The graphic displays 138 may cover an area on both sides of each wall (i.e., primary wall 22, secondary wall 24, and tertiary wall 26) that has an outer perimeter formed by the single channel that extends along or about the outer periphery of each wall. In the alternative, if the primary wall 22 includes separate channels that extend along or about the outer periphery of each sub-frame 42, then separate graphic displays 138 may be disposed on both sides of each sub-frame, where each graphic display 138 covers an area that has an outer perimeter formed by the single channel that extends along or about the outer periphery of each sub-frame 42. The image portion 142 of the graphic displays 138 along one side of the partition system 22 may have a more office friendly image or décor (e.g., a company logo) while the image portion 142 of the graphic displays 138 along the other side of the partition system 22 may have a more home friendly décor (e.g., artwork that is to the liking of the homeowner).

Sound proofing 144 boards may be disposed within the internal spaces 146 of each wall (i.e., primary wall 22, secondary wall 24, and tertiary wall 26). The sound proofing boards 144 may also function as or may be replaced by filters to filter the air around the partition system 20. Additional T-slots 148 or other channels (e.g., cutouts in the top members 36, 44, bottom members 38, 46, and/or side members 40, 48) may be defined by the walls (i.e., primary wall 22, secondary wall 24, and tertiary wall 26) or frames (i.e., first frame 28, second frame, and 30 third frame 32). The additional T-slots 148 may be utilized to mount addition structures or devices within the internal spaces 146. The additional T-slots 148 or other channels (e.g., cutouts in the top members 36, 44, bottom members 38, 46, and/or side members 40, 48) may be utilized to route electrical wires to various devices that may be used in conjunction with or are mounted to the partition system 20 (e.g., lamps, fans for filtrations system, etc.).

It is noted that the cross-section in FIG. 6 is illustrated as representative of a top portion of the primary wall 22 including the top member 44 of the first frame 22. However, it should be understood that FIG. 6 may also be representative of the top portion of either the secondary wall 24 or the tertiary wall 26 or a bottom portion of any of the walls (i.e., the primary wall 22, secondary wall, and 24 tertiary wall 26) when rotated 180°.

It is also noted that at least some of the walls and their corresponding frames are depicted as having a flat side (see the side of the primary wall 22 facing the bottom of the page in FIG. 3) and a curved or bowed side (see the side of the primary wall 22 facing the top of the page in FIG. 3). However, it should be understood that each wall (i.e., the primary wall 22, secondary wall, and 24 tertiary wall 26) and the corresponding frame (i.e., the first frame 28, second frame 30, and third frame 32) to each wall may have two flat sides, two bowed sides, or a combination of one flat side and one bowed side.

Referring to FIG. 1, an air channel 150 may be defined within one or more of the walls (i.e., primary wall 22, secondary wall 24, and tertiary wall 26) or frames (i.e., first frame 28, second frame, and 30 third frame 32). An air filter 152 may be disposed within the air channel 150. An air mover 154 (e.g., a fan) may be configured to direct air through the air channel 150 and across the air filter 152. The air mover 154 may receive electrical power from electrical cables that are routed through various internal channels.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A partition system comprising:

a primary wall having a first frame, wherein a lower end of the first frame defines an orifice;

a base including a post extending upward and through the orifice such that the primary wall is rotatable about the post extending though the orifice;

an A-frame rotatably secured an upper end of the post and rigidly secured to a top side of a bottom member of the first frame;

a secondary wall having a second frame secured to the first frame such that the secondary wall is rotatable about an axis relative to the primary wall, wherein the second frame defines (i) an internal cavity and (ii) a slot along an outer side edge;

an extension panel, wherein the (i) extension panel is slidably secured to the second frame within the internal cavity and is configured to slide at least partially into and out of the internal cavity via the slot; and a tertiary wall having a third frame rotatably secured to the first frame on an opposing side of the first frame relative to the secondary wall such that the tertiary wall is rotatable about a second axis relative to the primary wall, and wherein the secondary and tertiary walls are each configured to pivot inward toward the primary wall.

2. The partition system of claim 1, wherein the second frame is secured to the first frame via a hinge, and wherein the hinge is arranged such that (i) adjacent side edges of the first and second frames define a gap therebetween when the secondary wall is in a nonplanar position relative to the primary wall and (ii) the adjacent side edges of the first and second frames contact each other and close the gap when the secondary wall is in a substantially planar position relative to the primary wall.

3. The partition system of claim 2, wherein the hinge (i) includes a first plate that is secured to the first frame, (ii) a second plate that is secured to the second frame, and (iii) a pivot that defines the axis and rotatably secures the first plate to the second plate, wherein (a) a first region of the first plate overhangs the adjacent side edge of the first frame, (b) a first region of the second plate overhangs the adjacent side edge of the second frame, (c) a second region of the first plate overhangs a forward edge of the first frame, (d) a second region of the second plate overhangs a forward edge of the second frame, and (e) the pivot extends through the second region of the first plate and the second region of the second plate such that the pivot is offset from the forward edges of the first and second frames, respectively.

4. The partition system of claim 3, wherein the first region and second region of one of the first plate and the second plate is elevated relative to a remainder of the one of the first plate and second plate such that a notch is defined below the first region and second region of the one of the first plate and the second plate, wherein the notch is configured to receive the first region and the second region of the other of the first plate and the second plate when the secondary wall is in the substantially planar position relative to the primary wall.

5. The partition system of claim 3 further comprising (i) a first support block disposed within an internal space defined by a top member of the first frame and (ii) a second support block disposed within an internal space defined by a top member of the second frame, wherein the first plate is secured to the first frame via fasteners engaging the first plate, extending through the top member of the first frame, and engaging the first support block, and the second plate is secured to the second frame via fasteners engaging the second plate, extending through the top member of the second frame, and engaging the second support block.

6. The partition system of claim 1 further comprising a subdivider panel rotatably secured to the second frame such that the subdivider panel is configured to pivot about a second axis relative to the second frame, wherein the subdivider panel is configured to transition between a first position that is substantially parallel with the secondary wall and a second position that is radially offset from secondary wall relative to the second axis, and wherein in the first position the subdivider panel is (i) positioned against a forward facing surface of the secondary wall, (ii) disposed between opposing side members of the second frame, and (iii) disposed between top and bottom members of the second frame.

7. The partition system of claim 6 further comprising arms rotatably securing the subdivider panel to a top and a bottom of the second frame, wherein the arms are offset relative to the subdivider panel to facilitate the positioning the subdivider panel against the forward facing surface of the secondary wall when the subdivider panel is in the first position.

8. The partition system of claim 7 further comprising friction reducing plates disposed between the arms and the second frame.

9. The partition system of claim 1, wherein the first frame defines a channel that extends about a periphery of the primary wall, wherein the channel is open along a front side of the primary wall and is bound between and an outer wall and an internal wall on the first frame, and further comprising a graphic display having an outer edge that is disposed within the channel and engages the outer and internal walls to secure the graphic display to the first frame.

10. The partition system of claim 9, wherein the outer edge of the graphic display has an elasticity that is greater than elasticities of the outer and inner walls on the first frame.

11. The partition system of claim 9, wherein (i) the first frame defines T-slots disposed internally relative to the channel, (ii) the first frame includes a top member, a bottom member, and side members, and (iii) further comprising L-shaped brackets disposed within the T-slots and operable to secure the adjacent members of the top member, the bottom member, and the side members to each other.

12. The partition system of claim 1, wherein the second frame defines a channel that extends about a periphery of the secondary wall, wherein the channel is open along a front side of the secondary wall and is bound between and an outer wall and an internal wall on the second frame and further comprising a graphic display having an outer edge that is disposed within the channel and engages the outer and internal walls to secure the graphic display to the second frame.

13. The partition system of claim 1 further comprising a channel defined within one of the first and second frames, an air filter disposed within the channel, and an air mover configured to direct air through the channel and across the air filter.

14. The partition system of claim 1, wherein the primary wall defines channels configured to route electrical wires.

15. The partition system of claim 1 further comprising a bushing secured to the lower end of the frame and disposed within the orifice, wherein the post rotatably engages the bushing.

16. The partition system of claim 1 further comprising a base rotatably secured to a lower end of the first frame and configured to support the primary wall, wherein the primary wall and secondary wall are collectively configured to pivot about the base.

17. The partition system of claim 1 further comprising (i) a first rail secured to a bottom side of a top member of the second frame within the internal cavity, (ii) a second rail secured to a top side of a bottom member of the second frame within the internal cavity, and (iii) first and second bearing blocks slidably securing the extension panel to the first and second rails, respectively.

18. The partition system of claim 1, wherein first frame comprises a plurality of stacked frames.

19. A partition system comprising:

a primary wall having a first frame;

a secondary wall having a second frame secured to the first frame via a hinge such that the secondary wall is rotatable about an axis relative to the primary wall, wherein the second frame defines (i) an internal cavity and (ii) a slot along an outer side edge, wherein the hinge is arranged such that (a) adjacent side edges of the first and second frames define a gap therebetween when the secondary wall is in a nonplanar position relative to the primary wall and (b) the adjacent side edges of the first and second frames contact each other and close the gap when the secondary wall is in a substantially planar position relative to the primary wall, wherein the hinge (I) includes a first plate that is secured to the first frame, (II) a second plate that is secured to the second frame, and (III) a pivot that defines the axis and rotatably secures the first plate to the second plate, wherein (A) a first region of the first plate overhangs the adjacent side edge of the first frame, (B) a first region of the second plate overhangs the adjacent side edge of the second frame, (C) a second region of the first plate overhangs a forward edge of the first frame, (D) a second region of the second plate overhangs a forward edge of the second frame, and (E) the pivot extends through the second region of the first plate and the second region of the second plate such that the pivot is offset from the forward edges of the first and second frames, respectively;

a first support block disposed within an internal space defined by a top member of the first frame;

a second support block disposed within an internal space defined by a top member of the second frame, wherein the first plate is secured to the first frame via fasteners (i) engaging the first plate, (ii) extending through the top member of the first frame, and (iii) engaging the first support block, and wherein and the second plate is secured to the second frame via fasteners (a) engaging the second plate, (b) extending through the top member of the second frame, and (c) engaging the second support block;

an extension panel, wherein the (i) extension panel is slidably secured to the second frame within the internal cavity and is configured to slide at least partially into and out of the internal cavity via the slot; and a tertiary wall having a third frame rotatably secured to the first frame on an opposing side of the first frame relative to the secondary wall such that the tertiary wall is rotatable about a second axis relative to the primary wall, and wherein the secondary and tertiary walls are each configured to pivot inward toward the primary wall.

20. A partition system comprising:

a primary wall having a first frame;

a secondary wall having a second frame secured to the first frame such that the secondary wall is rotatable about an axis relative to the primary wall, wherein the second frame defines (i) an internal cavity and (ii) a slot along an outer side edge;

an extension panel, wherein the (i) extension panel is slidably secured to the second frame within the internal cavity and is configured to slide at least partially into and out of the internal cavity via the slot;

a tertiary wall having a third frame rotatably secured to the first frame on an opposing side of the first frame relative to the secondary wall such that the tertiary wall is rotatable about a second axis relative to the primary wall, and wherein the secondary and tertiary walls are each configured to pivot inward toward the primary wall;

a subdivider panel rotatably secured to the second frame such that the subdivider panel is configured to pivot about a second axis relative to the second frame, wherein the subdivider panel is configured to transition between a first position that is substantially parallel with the secondary wall and a second position that is radially offset from secondary wall relative to the second axis, and wherein in the first position the subdivider panel is (i) positioned against a forward facing surface of the secondary wall, (ii) disposed between opposing side members of the second frame, and (iii) disposed between top and bottom members of the second frame; and arms rotatably securing the subdivider panel to a top and a bottom of the second frame, wherein the arms are offset relative to the subdivider panel to facilitate the positioning the subdivider panel against the forward facing surface of the secondary wall when the subdivider panel is in the first position.

21. The partition system of claim 20 further comprising friction reducing plates disposed between the arms and the second frame.

* * * * *